US005757121A

United States Patent [19]

Nakata

[11] Patent Number: 5,757,121

[45] Date of Patent: May 26, 1998

[54] APPARATUS FOR REDUCING DEFLECTION ABERRATION IN A CRT

[75] Inventor: Shuhei Nakata, Hyogo, Japan

[73] Assignee: Mitsubishi Denki Kabushiki Kaisha, Tokyo, Japan

[21] Appl. No.: 499,001

[22] Filed: Jul. 6, 1995

[30] Foreign Application Priority Data

Feb. 8, 1995 [JP] Japan ..... 7-020329

[51] Int. Cl.[6] ..... H01J 29/76

[52] U.S. Cl. ..... 313/440; 313/426; 313/430

[58] Field of Search ..... 313/440, 426, 313/428, 430, 433, 437

[56] References Cited

U.S. PATENT DOCUMENTS

| | | | |
|---|---|---|---|
| 4,670,726 | 6/1987 | Ogata et al. | 313/427 |
| 4,758,762 | 7/1988 | Van Gorkum et al. | 313/440 |
| 4,961,021 | 10/1990 | Oguro et al. | 313/440 |
| 5,027,042 | 6/1991 | Sluyterman et al. . | |
| 5,327,051 | 7/1994 | Johnson et al. . | |
| 5,399,933 | 3/1995 | Tsai | 313/431 |
| 5,465,026 | 11/1995 | Roussel et al. | 313/440 |

FOREIGN PATENT DOCUMENTS 62-24542 2/1987 Japan .

*Primary Examiner*—Sandra L. O'Shea
*Assistant Examiner*—Vip Patel
*Attorney, Agent, or Firm*—Burns, Doane, Swecker & Mathis, LLP

[57] ABSTRACT

In an in-line beam type CRT, at least one pair of quadrupole electromagnets and at least one pair of quadrupole electromagnets rotated by 45° about a beam axis are provided around a neck portion of a deflection yoke. Further, electric field lenses for respectively applying quadrupole electric fields to beams are mounted to an electron gun. Thus, the CRT can provide satisfactory spot shapes over the entire surface of a screen thereof and hence achieve high resolution.

15 Claims, 17 Drawing Sheets

QUADRUPOLE MAGNETIC FIELD

SKEW QUADRUPOLE MAGNETIC FIELD

UNIFORM MAGNETIC FIELD

PINCUSHION-SHAPED MAGNETIC FIELD

BARREL-SHAPED MAGNETIC FIELD

APPARATUS FOR REDUCING DEFLECTION ABERRATION IN A CRT

BACKGROUND OF THE INVENTION

1. Field of the Invention

The present invention relates to an improvement in image quality, specifically, resolution of a CRT (Cathode Ray Tube), and principally to an improvement in image quality of a color CRT.

2. Description of the Related Art

A conventional color CRT utilizes various means in order to improve the quality of an image. However, the prior art devices cause new unsolvable problems as the demand for improvement in the image quality, specifically, resolution increases. The prior art and its problems will be described below by the following examples.

[First prior art]

FIGS. 15A through 15F show a method of improving shapes of beam spots on a CRT, which has been described in Japanese Utility Model Application Laid-Open No. 2-129651. The principle thereof is intended to provide a single quadrupole electromagnet and a power supply for controlling current values and magnetism of the quadrupole electromagnet according to positions of beams on a screen and to circularize beam spot shapes at the corners of the screen.

This prior art has a problem in that the positions on the screen where the beam spot shapes can be improved, are limited to either one of a vertical/horizontal direction and a corner direction (direction of 45°) and the beam spot shapes cannot be improved over the entire surface of the screen.

[Second prior art]

FIGS. 16A through 16E illustrate a method of solving deflection astigmatisms of an in-line type color CRT, which has been described in Japanese Patent Application Laid-Open No. 62-24542. The principle thereof is as follows. As shown in FIG. 16A, octpole yokes each having two windings for producing two kinds of quadrupole magnetic fields whose directions are different 45° from each other, are used as a single correction yoke 1. One of the windings is supplied with a signal obtained by modulating a parabolic wave having a horizontal scanning period in a vertical scanning period, whereas the other one thereof is supplied with a signal obtained by modulating a sawtooth wave having a horizontal scanning period in a vertical scanning period, thereby reducing deflection astigmatisms at respective points on a screen.

This method is intended to reduce the deflection astigmatisms over the entire surface of the screen under the operations of a convergence electrode 42, a dynamic convergence yoke 43 and the correction yoke 1. FIG. 16C illustrates magnetic fields produced by the correction yoke 1. FIGS. 16D and 16E respectively show spot shapes on the screens before and after correction of astigmatism.

This prior art has problems in that since it is necessary to provide the correction yoke 1 in the neighborhood of a main lens G4 at which R, G and B beams intersect, in order to cause the correction yoke 1 to perform the correction of beam spot shapes alone and to avoid influences over a convergence function, the correction yoke 1 cannot approach a deflection yoke that produces the astigmatism, thereby making it difficult to satisfactorily correct the astigmatism. Therefore, spots at a peripheral portion of the screen cannot be reduced in diameter as shown in FIG. 16E even after the astigmatism has been corrected. Further, the convergence electrode 43 must be disposed in front of the main lens, thereby causing a problem that the overall length of an electron gun is made longer.

[Third prior art]

FIGS. 17A and 17B illustrate an example of a structure of a conventional color CRT. The source thereof is known per se from a technical report by Mitsubishi Electric Corp., Vol. 68, p 168 (1994). FIG. 17A shows the overall structure of the color CRT. FIG. 17B illustrates the structure of a mask. In the drawing, "A" indicates a frame for mounting a shadow mask, which is made of steel having a thickness of about 20 mm and a coefficient of low thermal expansion for the purpose of applying a strength to the entire CRT.

A problem arises that since the steel having a coefficient of low thermal expansion is generally high in permeability, the steel for the frame is apt to be magnetized by a magnetic field supplied from the outside and the orbit of an electron beam is disturbed in the vicinity of the screen by a magnetic field produced by the magnetized frame. The disturbance of the orbit of the electron beam causes problems such as distortion of an image, a color variation, a reduction in resolution, etc.

Although no trouble is produced so long as the magnetized frame is demagnetized, since the conventional frame for the CRT is made of steel increased in thickness, a high-frequency magnetic field used for demagnetization is hard to penetrate into the inside of the steel, thereby making it difficult to demagnetize the frame. This results from a phenomenon called skin effect. This can be avoided if the frequency of the demagnetizing high-frequency magnetic field is lowered. In doing so, however, a problem arises that a power supply for an electromagnet leads to a large scale.

The first prior art is accompanied by a problem that the satisfactory correction of the spot shapes on the screen is limited to either one of the vertical/horizontal direction and the direction of 45°.

The second prior art is accompanied by a problem that since it is necessary to locate the correction yoke corresponding to an aberration correcting means in a position spaced away from the deflection yoke that produces aberration, the aberration cannot be sufficiently corrected and the overall length of the electron gun becomes longer.

The third prior art is accompanied by a problem that since the frame for the shadow mask is made of the thick plate, the high-frequency magnetic field corresponding to a normal demagnetizing means does not penetrate into the frame, thereby making it difficult to demagnetize the frame.

SUMMARY OF THE INVENTION

An object of the present invention is to solve the aforementioned problems of the prior art devices, improve spot shapes over the entire surface of a screen and achieve high resolution.

According to a first aspect of the present invention, there is provided an in-line beam type CRT comprising at least one pair of quadrupole electromagnets provided around a neck portion of a deflection yoke, at least one pair of quadrupole electromagnets rotated by 45 degrees about a beam axis, which is provided around the neck portion of the deflection yoke, and electric field lenses mounted to an electron gun, for respectively applying quadrupole electric fields to beams.

According to a second aspect of the present invention, there is provided an in-line beam type CRT comprising at least one pair of quadrupole electromagnets provided around a neck portion of a deflection yoke, at least one pair of quadrupole electromagnets rotated by 45 degrees about a beam axis, which is provided around the neck portion of the deflection yoke, and an electric field lens mounted to an electron gun, for inwardly deflecting outer beams.

According to the first and second aspects of the present invention, as stated above, since a sextupole magnetic field produced by the deflection yoke is made unnecessary, a strong astigmatism is prevented from occurring due to the sextupole magnetic field. Further, since each astigmatism correcting means can be provided adjacent to a portion where astigmatism is produced, the astigmatism can be effectively corrected and satisfactory spot shapes can be obtained over the entire surface of a screen, thereby making it possible to obtain high resolution.

According to a third aspect of the present invention, there is provided a single beam type CRT wherein sextupole components of horizontal and vertical magnetic fields produced by a deflection yoke are disposed in a triplet arrangement and a skew quadrupole magnet is provided around a neck portion of the deflection yoke.

According to a fourth aspect of the present invention, there is provided a CRT wherein a triplet arrangement of sextupole magnetic fields produced by a deflection yoke is constructed by winding distributions of deflection coils.

According to a fifth aspect of the present invention, there is provided a CRT wherein a triplet arrangement of sextupole magnetic fields produced by deflection coils is constructed by a deflection yoke producing sextupole components of magnetic fields and a pair of magnetic members disposed before and after the deflection yoke, for inverting the sign of each sextupole magnetic field.

According to the third through fifth aspects of the present invention, as stated above, a single skew quadrupole magnet may be provided as an alternative to quadrupole magnets or skew quadrupole magnets that were necessary to provide in plural form and satisfactory spot shapes can be obtained over the entire surface of a screen, thereby making it possible to obtain high resolution.

According to a sixth aspect of the present invention, there is provided an in-line beam type CRT having a self-converged yoke, comprising a coma-aberration correcting sextupole magnet provided around a neck portion of a deflection yoke, for setting the amount of correction for coma-aberration excessive, and a ring made of a magnetic substance, which is provided in the neighborhood of the sextupole magnet and is capable of adjusting a distance to the sextupole magnet.

According to the sixth aspect of the present invention, as stated above, the excess and deficiency of correction of coma-aberration can be easily adjusted and satisfactory spot shapes can be obtained over the entire surface of a screen, thereby making it possible to obtain high resolution.

According to a seventh aspect of the present invention, there is provided a CRT comprising a quadrupole electric field lens provided so as to correspond to in-line type beams and having bill-shaped electrodes which intersect at right angles, are opposed to each other and have such shapes that widths of the bill-shaped electrodes are respectively varied toward leading ends thereof along beam axes.

According to the seventh aspect of the present invention, as stated above, since astigmatism can be satisfactorily corrected and can be stably corrected even when the position of each beam varies, satisfactory spot shapes can be obtained over the entire surface of a screen, thereby making it possible to obtain high resolution.

According to an eighth aspect of the present invention, there is provided a CRT comprising a beam convergent lens composed of a plurality of cylindrical electrodes provided coaxially with each other and having opposed sections perpendicular to an axis thereof, which have circumferentially-extending shapes set to waveforms and brought into engagement with each other.

According to a ninth aspect of the present invention, there is provided a CRT comprising a beam convergent lens having a coaxially-provided cylindrical electrode with slits which are defined therein, provided inside the cylindrical electrode, shorter than the cylindrical electrode and extend in an axial direction thereof.

According to the eighth and ninth aspects of the present invention, as stated above, spherical astigmatism of a beam convergent lens is reduced and satisfactory spot shapes can be obtained over the entire surface of a screen, thereby making it possible to obtain high resolution.

According to a tenth aspect of the present invention, there is provided a CRT comprising a shadow mask, and a frame for mounting the shadow mask thereto, which is composed of thin plates corresponding to steel plates stacked on one another in a direction parallel to a screen of the CRT.

According to the tenth aspect of the present invention, as stated above, a conventional frame of a shadow mask can be easily demagnetized by a demagnetizing high-frequency electric field and satisfactory spot shapes can be obtained over the entire surface of a screen, thereby making it possible to obtain high resolution.

According to an eleventh aspect of the present invention, there is provided a resolution improving apparatus suitable for use in a CRT, comprising a conveyor for conveying the CRT, and a plurality of magnets which are provided along the conveyor so as to be opposed to one another in pairs on both sides of the conveyor, which have directions of magnetic fields, which are inverted every magnet pairs, and which have magnetic-field strengths reduced from the upstream side of the conveyor to the downstream side thereof, and wherein the CRT placed on the conveyor is caused to pass through alternating magnetic fields produced by the magnet pairs to thereby apply attenuated alternating magnetic fields to a frame of the CRT.

According to a twelfth aspect of the present invention, there is provided a resolution improving apparatus suitable for use in a CRT, comprising a pair of electromagnets opposed to each other, a rotatable table for placing the CRT thereon and rotating the same between the pair of electromagnets, a rotary mechanism for rotating the rotatable table, and a d.c. power supply for supplying a current to the electromagnet pair and varying a value of the current on a time basis, whereby attenuated alternating magnetic fields are applied to a frame of the rotated CRT.

According to a thirteenth aspect of the present invention, there is provided a resolution improving apparatus suitable for use in a CRT, comprising a pair of magnets opposed to each other, a rotatable table for placing the CRT thereon and rotating the same between the pair of magnets, and a drive mechanism for varying a relative distance between the CRT and the magnet pair, whereby attenuated alternating magnetic fields are applied to a frame of the rotated CRT.

According to the eleventh through thirteenth aspects of the present invention, as stated above, a conventional frame of a shadow mask, which is composed of thick plates, can be easily demagnetized and satisfactory spot shapes can be obtained over the entire surface of a screen, thereby making it possible to obtain high resolution.

According to a fourteenth aspect of the present invention, there is provided a CRT wherein the resolution improving apparatus according to the eleventh, twelfth or thirteenth aspect of the present invention applies attenuated alternating magnetic fields to a frame of the CRT so as to demagnetize the frame.

According to the fourteenth aspect of the present invention, as stated above, a conventional frame of a shadow mask, which is composed of thick plates, can be easily demagnetized and satisfactory spot shapes can be obtained over the entire surface of a screen, thereby making it possible to obtain high resolution.

The above and further objects and novel features of the invention will become more fully apparent from the following description of the preferred embodiments when read in conjunction with the accompanying drawings. It is to be expressly understood, however, that the drawings are for purpose of illustration only and not intended as a definition of the limits of the invention.

DETAILED DESCRIPTION OF THE PREFERRED EMBODIMENTS

Preferred embodiments of the present invention will hereinafter be described in detail with reference to the accompanying drawings.

[First embodiment]

The present embodiment is intended to realize elimination of a sextupole magnetic field of a deflection yoke, that leads to deflection aberration in a conventional in-line type CRT, and a high-precision compensation or correction for the shape of each beam spot. In the conventional in-line type CRT, sextupole magnetic field components are produced by the deflection yoke to obtain convergence of three R, G and B beams. However, the sextupole magnetic field produces an astigmatism resistant to a beam spot. A quadrupole electric-field lens or the like disposed in an electron gun assembly has been used as a means for correcting this astigmatism. However, a high-precision correction falls into difficulties due to a very large amount of astigmatism. Since a strong high-frequency magnetic field of a deflection yoke corresponding to a portion where the astigmatism occurs, interferes in the quadrupole field lens and a main lens, the arrangement of such lenses in the vicinity of the deflection yoke makes it difficult to correct or compensate for the astigmatism.

Figure 1A:
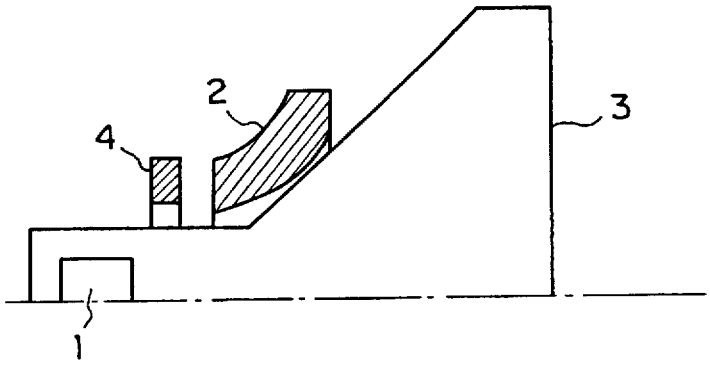
FIGS. 1A through 1H are respectively views showing a configuration and effects of a CRT according to a first embodiment of the present invention.

The present embodiment will be described below with reference to the accompanying drawings. FIGS. 1A through 1H respectively illustrate a configuration and effects of a CRT according to the present embodiment. FIG. 1A is a view showing a basic configuration of the color CRT according to the present embodiment. Reference numeral 1 indicates an in-line type electron gun. Reference numeral 2 indicates a deflection yoke. Reference numeral 3 indicates a vacuum tube including a screen. Reference numeral 4 indicates a correction yoke.

Figure 1B:
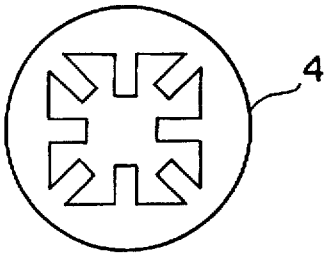
Figure 1C:
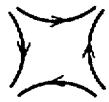
Figure 1D:
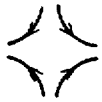

FIG. 1B shows the correction yoke. FIGS. 1C and 1D respectively illustrate magnetic fields produced by the correction yoke. The correction yoke 4 is a combination of two pairs of quadrupole magnets for producing a quadrupole magnetic field for applying a horizontal or vertical action to a beam and a quadrupole magnetic field (hereinafter called "skew quadrupole magnetic field") obtained by rotating the qaudrupole magnetic field by 45 degrees. The correction yoke 4 consists of 8 poles in total. The correction yoke 4 has two pairs of coils corresponding to the two pairs of quadrupole magnets and skew quadrupole magnets. Configurations of the quadrupole magnetic field and the skew quadrupole magnetic field will be shown on the right side as seen in FIG. 1C and 1D.

Incidentally, the quadrupole magnets and the skew quadrupole magnets may be separately provided.

Figure 1E:
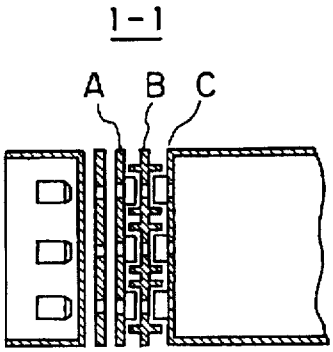
Figure 1F:
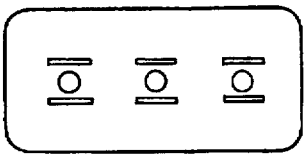
Figure 1G:
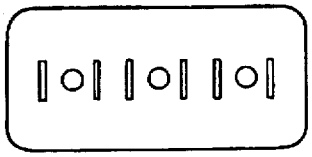
Figure 1H:
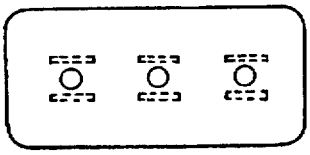

FIG. 1E shows one example of a structure of a quadrupole field lens 1—1 disposed inside the electron gun 1. FIGS. 1F through 1H respectively illustrate quadrupole field lenses A, B and C relative to beams R, G and B.

The operation of the present embodiment will now be described.

The deflection yoke 2 employed in the present embodiment is different from a conventional deflection yoke and provides a uniform magnetic field free of a sextupole magnetic field, for obtaining beam convergence. The beam convergence is obtained by the quadrupole magnetic field of the correction yoke 4. As a result of the beam convergence, an astigmatism occurs in each beam spot. However, the amount of the astigmatism is reduced as compared with the case where the convergence is obtained by a sextupole magnetic field of the conventional deflection yoke.

The correction of the astigmatism produced in the beam spot in a slanting direction on the screen is performed by means of the skew quadrupole magnetic field of the correction yoke 4. The correction of the astigmatisms in the horizontal/vertical directions is performed by the quadrupole field lens 1—1 of the electron gun 1. In the present embodiment, the correction of the astigmatisms can be easily performed with high accuracy because an astigmatism correcting means can be disposed adjacent to a portion where the astigmatism is produced.

Although an error in convergence (coma-aberration) is left between each of outer two beams of in-line type beams and a central beam thereof, this error may solve by providing a winding or a magnetic substance or member for producing a sextupole magnetic field at a neck portion of the deflection yoke. The strength of a component for the generation of the sextupole magnetic field, which is necessary for this error countermeasure, is lower than that of one for the generation of a sextupole magnetic field intended to obtain conventional convergence. Astigmatism produced therein can be neglected.

The correction of the astigmatism produced in the beam spot by the correction yoke 4 and the quadrupole field lens 1—1 is performed by control voltages (currents) supplied to corresponding correcting means. However, these control voltages are controlled to values required in correspondence with the position of the beam spot on the screen. A control power supply used for the generation of the control voltages is similar to a control power supply employed in the prior art, for producing a parabolic or sawtooth voltage waveform. In a high-precision CRT, a voltage applied to a beam convergent lens of the electron gun is also normally changed so as to correspond to the position of the spot.

Since the quadrupole field lens 1—1 of the electron gun is provided so as to correspond to beams of R, G and B as shown in FIG. 1E, the correction of astigmatisms in the horizontal/vertical directions does not exert an influence on the convergence made by the correction yoke 4 and the correction of astigmatism in the slanting direction. The correction of astigmatism in the slanting direction by the skew quadrupole magnetic field of the correction yoke 4 does not interfere in other beam correcting functions either. The correction of the astigmatism itself includes a diagonally converging action but is a part of an astigmatism correcting function. This does not interfere in other correction. Thus, the convergence and the astigmatism correction can be performed independently of each other. This independence facilitates control of a voltage corresponding to the position of the beam spot on the screen.

In the present embodiment, since a strong astigmatism can be prevented from occurring due to the sextupole magnetic field of the conventional deflection yoke, the astigmatism can be highly accurately corrected. Further, since the correction yoke bearing the convergence and each astigmatism correcting means can be disposed adjacent to each other, the correction of astigmatism is made easy. Accordingly, satisfactory spot shapes are obtained over the entire surface of the screen and high resolution is obtained. Since the actions of the respective astigmatism correcting means are easily independent of one another, the astigmatism correction can be performed with ease.

[Second embodiment]

The present embodiment shows another example of a technique in which the sextupole magnetic field of the deflection yoke is made unnecessary in a manner similar to the first embodiment.

Figure 2A:
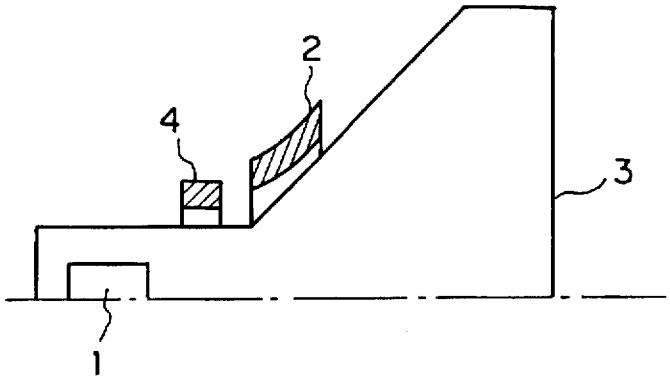
FIGS. 2A and 2B are respectively views illustrating a configuration and an effect of a CRT according to a second embodiment of the present invention.
Figure 2B:
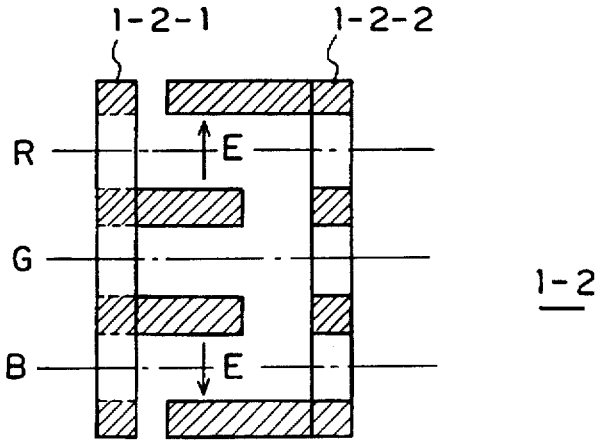

FIGS. 2A and 2B are respectively views for describing a configuration and operating characteristic of a CRT according to the present embodiment. In FIG. 2A, elements designated at numerals 1 through 4 are identical to those described in the first embodiment. FIG. 2B is a cross-sectional view of a beam convergence field lens 1-2 provided inside an electron gun 1 as seen from a beam common surface thereof. The field lens 1-2 is composed of two electrodes 1-2-1 and 1-2-2. The respective electrodes consist of two plate-like electrodes having holes for allowing three beams of R, G and B to pass therethrough. One of the plate-like electrode has two tooth-shaped electrodes that interpose a central beam therebetween, whereas the other electrode thereof has two tooth-shaped electrodes that interpose outer beams therebetween. These tooth-shaped electrodes extend orthogonally to the beam common surface.

The operation of the present embodiment will be described below. In the present embodiment, beam convergence is performed by the field lens 1-2 provided inside the electron gun 1. If a potential difference is provided between the two electrodes 1-2-1 and 1-2-2 of the field lens 1-2, then an inwardly-deflected action is applied to the outer beams alone to make convergence. Accordingly, the deflection yoke eliminates the need for the generation of the sextupole magnetic field and provides a uniform magnetic field.

A quadrupole magnetic field produced by a correction yoke 4 corrects astigmatisms in horizontal/vertical directions and a skew quadrupole magnetic field corrects an astigmatism in a slanting direction. Since the field lens 1-2 mostly bears a convergence function, the correction yoke 4 may simply correct the astigmatism.

Since a deflection yoke provides a uniform magnetic field even in the case of the present embodiment, the astigmatism can be prevented from occurring due to the sextupole magnetic field of the conventional deflection yoke so that a high-precision spot correction can be performed. Since the convergence field lens 1-2 and the correction yoke 4 can be disposed adjacent to each other, the correction of astigmatism can be satisfactorily carried out. Thus, each satisfactory spot shape can be obtained over the entire surface of the screen and high resolution is achieved. Even in the case of the present embodiment, the convergence function and the spot correcting function interfere with each other less and hence the spot correction can be easily performed.

[Third embodiment]

The present embodiment shows a case where in a single beam CRT, each spot shape is corrected over the entire surface of a screen thereof by using a deflection yoke in which the polarity of a component of a sextupole magnetic field of the deflection yoke is alternately inverted along a beam axis with respect to the horizontal and vertical directions and a single skew quadrupole electromagnet. It was necessary for the prior art to provide a plurality of quadrupole electromagnets.

Figure 3A:
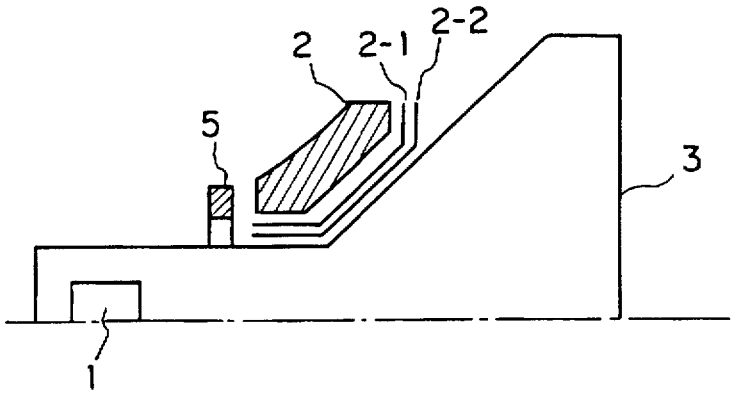
FIGS. 3A through 3C are respectively views depicting a configuration and effects of a CRT according to a third embodiment of the present invention.
Figure 3B:
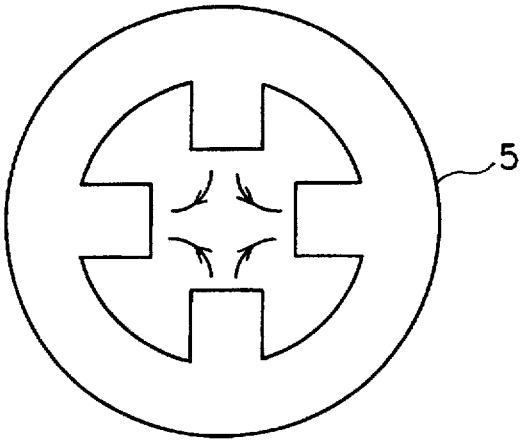
Figure 3C:
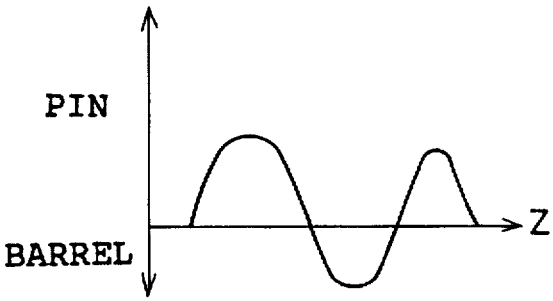

FIGS. 3A through 3C are respectively views for describing a configuration and effects of the CRT according to the present embodiment. In FIG. 3A, elements designated at numerals 1 through 3 are similar to those described in the first embodiment. Reference numeral 2-1 indicates a vertical deflection coil and reference numeral 2-2 indicates a horizontal deflection coil. Reference numeral 5 indicates a skew quadrupole electromagnet having a convergence/divergence action extending in a direction of 45 degrees. FIG. 3B illustrates a core for producing a core-shaped skew quadrupole magnetic field and the produced magnetic field. FIG.

3C shows a distribution of the component of the sextupole magnetic field of the deflection yoke, which extends along the beam axis.

Since it is unnecessary for the single beam CRT to obtain beam convergence, the degree of freedom is obtained upon design of the distribution of the magnetic field of the deflection yoke. The distribution of the sextupole magnetic field shown in FIG. 3C is obtained by designing a winding distribution. Since a magnetic field obtained by combining a sextupole magnetic field and a deflection magnetic field is brought to a pincushion shaped or barrel shaped magnetic field, a magnetic field obtained by combining the sextupole magnetic field shown in FIG. 3C and the deflection magnetic field forms magnetic field regions represented in order of pincushion, barrel and pincushion shapes along a beam axis, for example. The pincushion shaped magnetic field applies a diverging action to a beam and the barrel shaped magnetic field applies a converging action to the beam.

By allowing the beam to pass through three regions with a magnetic field distribution as, for example, divergence, convergence and divergence along the beam axis and jointly using a convergent force of an electromagnetic convergent lens (main lens), astigmatism and coma-aberration produced in the horizontal and vertical directions on the screen can be normally corrected. Thus, the direction in which the astigmatism remains on the screen can be limited to a slanting direction alone. The remaining astigmatism can be corrected by a single skew quadrupole electromagnet. Since the above-described astigmatism correction is performed in the present embodiment, each spot shape extending over the entire surface of the screen can be satisfactorily corrected by using only the single skew quadrupole electromagnet.

In order to correct the spot shape over the entire surface of the screen, it is generally necessary to satisfy focusing conditions and magnification in the two horizontal and vertical directions. Further, the degree of freedom required on design related to beam convergent conditions needs four.

As described above, the alternate arrangement of the magnetic field as represented in the form of divergence, convergence and divergence, for example, is generally called "triplet arrangement", in which the degree of freedom required on design related to the beam convergent conditions is three. If the degree of freedom of the main lens is added to the above degree of freedom, then the triplet arrangement has the degree of freedom corresponding to four. Thus, the four degrees of freedom required on design as referred to above can be satisfied.

[Fourth embodiment]

The third embodiment shows the case where each of the distributions of the pincushion shaped, barrel shaped and pincushion shaped magnetic fields is achieved by the winding distribution of the deflection yoke. However, the present embodiment is of one wherein the distribution of a magnetic field is formed by jointly using a pair of magnetic members and the design of the distribution of a winding is simplified.

Figure 4A:
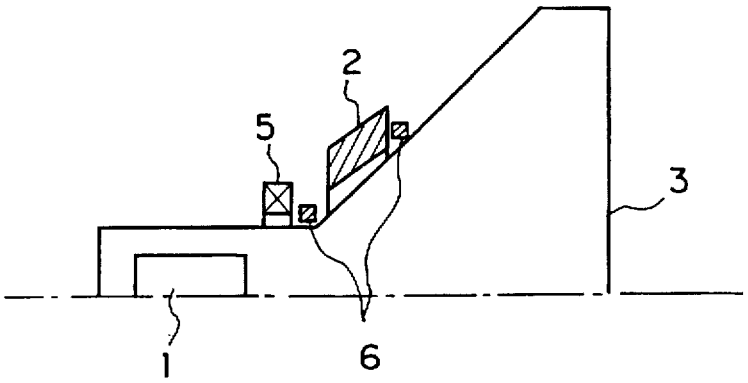
FIGS. 4A through 4E are respectively views illustrating a configuration and effects of a CRT according to a fourth embodiment of the present invention.
Figure 4B:
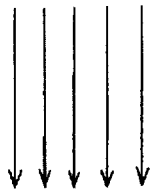
Figure 4C:
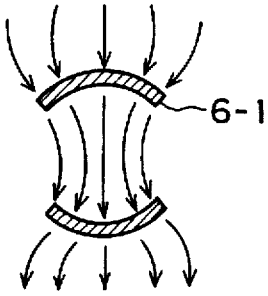
Figure 4D:
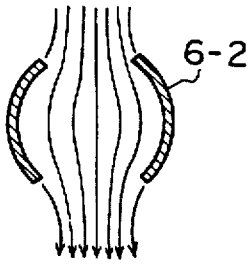
Figure 4E:
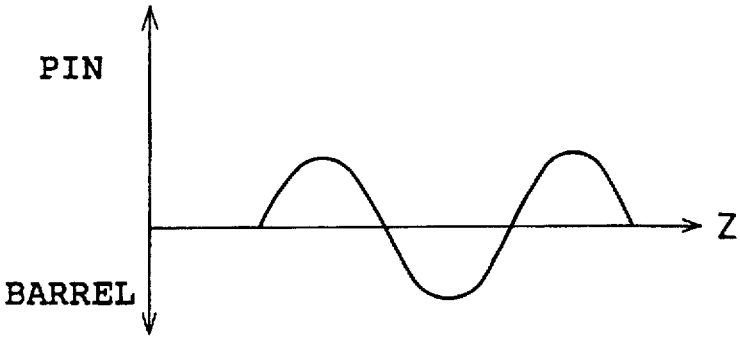

FIGS. 4A through 4E are respectively views for describing a configuration and effects of a CRT according to the present embodiment. In FIG. 4A, reference numeral 2 indicates a deflection yoke whose winding is designed so that a magnetic field is brought to a pincushion shaped or a barrel shaped magnetic field over its entirety. Reference numeral 6 indicates a pair of magnetic substances or members. FIGS. 4B through 4D are views showing examples of shapes of the pair of magnetic members 6 and their effects. The shape example 6-1 of the pair of magnetic members 6 acts so as to change a uniform magnetic field shown in FIG. 4B to a pincushion shaped magnetic field shown in FIG. 4C. The shape example 6-2 serves so as to change the uniform magnetic field shown in FIG. 4B to a barrel shaped magnetic field shown in FIG. 4D.

If the entire magnetic field of the deflection yoke is now regarded as the barrel shaped magnetic field, for example and the pair of magnetic members of the shape example 6-1 is provided at an entrance and an exit of the deflection yoke, then a magnetic field in a region adjacent to the pair of magnetic members can be changed to the pincushion shaped magnetic field. Therefore, the arrangement of the pincushion shaped, barrel shaped and pincushion shaped magnetic fields along the beam axis can be achieved in a manner similar to the third embodiment. The action of the shape example 6-1 corresponds to one obtained by inverting the sign of the component of the sextupole magnetic field of the deflection yoke. The present embodiment has a merit in that the winding distribution of the deflection yoke can be simplified and the magnetic field distribution can be adjusted by adjusting the arrangement of the magnetic members.

[Fifth embodiment]

The present embodiment relates to the correction of astigmatism of a self-converged yoke of a type wherein a quadrupole magnetic field is produced by a deflection yoke, and particularly facilitates the correction of coma-aberration.

Figure 5A:
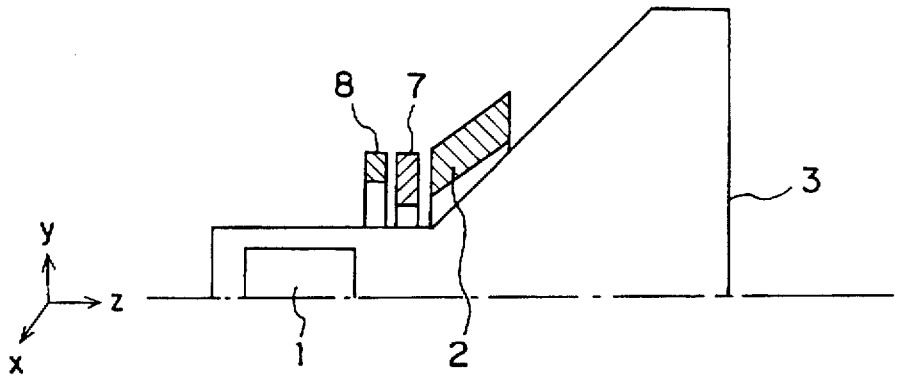
FIGS. 5A and 5B are respectively views showing a configuration and an effect of a CRT according to a fifth embodiment of the present invention.
Figure 5B:
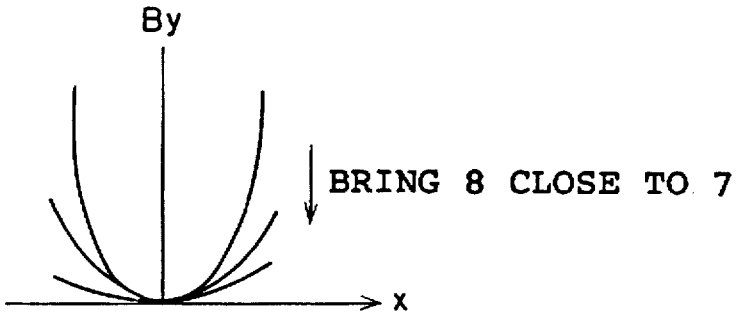

FIGS. 5A and 5B are respectively views for explaining a configuration and an effect of a CRT according to the present embodiment. FIG. 5A shows a basic configuration of the CRT. Reference numeral 2 indicates a self-converged yoke. Reference numeral 7 indicates a coma-aberration correcting yoke. Reference numeral 8 indicates a ring composed of a magnetic substance or member.

In the conventional self-converged yoke, a component of a sextupole magnetic field is contained in a deflection magnetic field to make beam convergence. The sextupole magnetic field has produced astigmatism developed in a beam and coma-aberration produced mutually among three beams. The coma-aberration has been corrected by separately providing a coma-aberration correcting yoke for producing the sextupole magnetic field, at a neck portion of a deflection yoke. Since, however, a solid difference is developed between strengths of sextupole magnetic fields due to a solid difference produced between coil windings of the deflection yoke, the correction of the coma-aberration has fallen into difficulties.

In the present embodiment, the strength of the sextupole magnetic field of the coma-aberration correcting yoke 7 is made excessive against a strength necessary to correct the coma-aberration. The ring 8 bypasses a magnetic flux to reduce the strength of the magnetic field. The coma-aberration is corrected by adjusting the position of the ring 8 in the vicinity of the coma-aberration correcting yoke 7. FIG. 5B shows a state in which the strength of a component (e.g., By) of the sextupole magnetic field of the coma-aberration correcting yoke 7 varies according to the position of the ring 8. Since the coma-aberration correcting yoke having the excessive strength of magnetic field and the ring for reducing the magnetic field so as to adjust its strength are used in the present embodiment, a satisfactory coma-aberration correction can be easily performed even if the solid difference exists between the strengths of the sextupole magnetic fields of the deflection yoke.

[Sixth embodiment]

The present embodiment relates to an electric field lens for correcting astigmatism produced due to deflection of an in-line type beam.

Figure 6A:
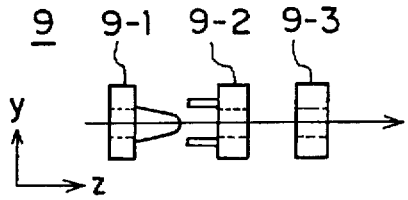
FIGS. 6A through 6E are respectively views depicting configurations and effects of a CRT according to a sixth embodiment of the present invention.
Figure 6B:
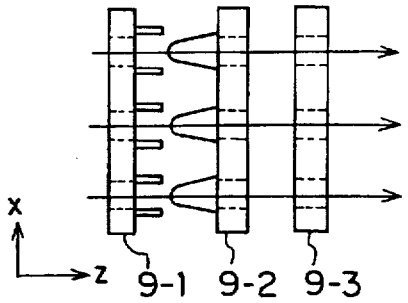
Figure 6C:
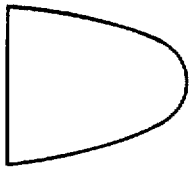

FIGS. 6A through 6E are respectively views for explaining configurations and effects of a CRT according to the present embodiment. FIG. 6A is a side view of a quadrupole electric field lens. FIG. 6B is a plan view of the quadrupole field lens. FIG. 6C shows a configuration of a partial electrode of the quadrupole field lens. The present field lens is constructed as shown in FIGS. 6A and 6B such that two electrodes each having the configuration shown in FIG. 6C are disposed in bill form with a beam interposed therebetween and the bill-shaped electrodes are disposed in an opposing relationship after they have been rotated by 90°. Reference numerals 9-1 and 9-2 indicate bill-shaped electrodes respectively. The electrodes designated at numerals 9-1 and 9-2 and an electrode designated at numeral 9-3 respectively have circular holes through which electron beams penetrate. These electrodes are disposed as designated at numerals 9-1 through 9-3 so as to correspond to the three electron beams as illustrated in FIG. 6B.

If a potential difference is now applied between the opposed electrodes 9-1 and 9-2, then a quadrupole electric field is produced. The present field lens has a feature that since the configuration of each electrode varies a width thereof along a beam traveling direction (z) as shown in FIG. 6C, a high-order electric field component other than a quadrupole electric field component is reduced. Therefore, the field lens has a merit that only beam astigmatism is corrected and other astigmatisms are not produced.

Figure 6D:
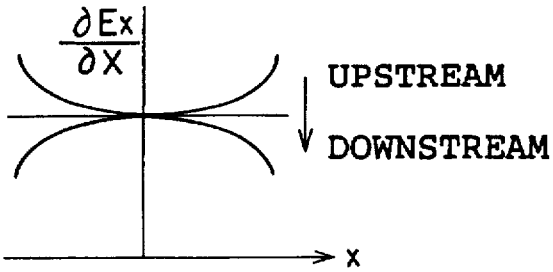
Figure 6E:
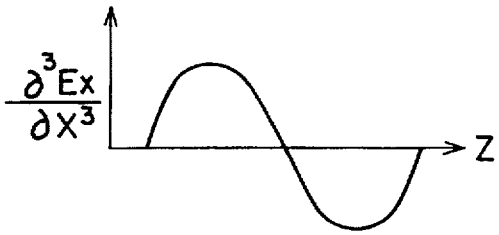

The reason that the quadrupole electric field component other than the high-order electric field component can be produced owing to the configuration of each electrode, is as follows. A distribution of the quadrupole electric field component (e.g., $\partial Ex/\partial X$) of the field lens is changed from a lower convex shape to an upper convex shape along the beam traveling direction z as shown in FIG. 6D. This means that the polarity of the high-order electric field component (e.g., $\partial E^3x/\partial X^3$ indicative of an octpole component) other than the quadrupole electric field component is inverted along the beam traveling direction as shown in FIG. 6E.

Thus, values obtained by integrating high-order electric field components along a beam axis are canceled each other and hence reduced. This also means that the total quadrupole electric field component to which each traveling electron beam is subjected, is reduced with respect to a beam transverse variation. As a result, the electron beams are equivalent to the central-axis beam even if the electron beams pass through positions distant from the central axis of the field lens, and they are subjected to the quadrupole electric field components exclusive of the high-order electric field components. Thus, only astigmatisms relative to the electron beams are corrected and other astigmatisms are no longer produced. Since the width of each electrode is made constant with respect to the beam traveling direction in this type of conventional electric field lens, an excellent effect described above cannot be obtained.

The present embodiment describes a case where the opposed bill-shaped electrodes are provided so as to extend in the horizontal/vertical directions and the astigmatisms in the horizontal/vertical directions are corrected. However, the opposed bill-shaped electrodes may also be rotated 45° together to correct astigmatisms in 45° directions. If horizontal/vertical electric field lenses and an electric field lens extending in a 45° direction are provided and voltages applied to the respective electric field lenses are controlled according to the position of each beam on the screen, astigmatisms in all directions can be corrected over the entire surface of the screen.

[Seventh embodiment]

The present embodiment relates to an improvement in spherical aberration of a beam convergent lens using opposed cylindrical electrodes.

Figure 7A:
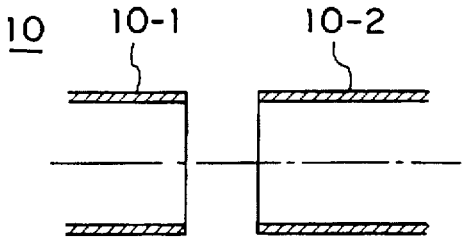
FIG. 7A (PRIOR ART)
FIGS. 7A through 7C are respectively views showing configurations of a CRT according to a seventh embodiment of the present invention.
Figure 7B:
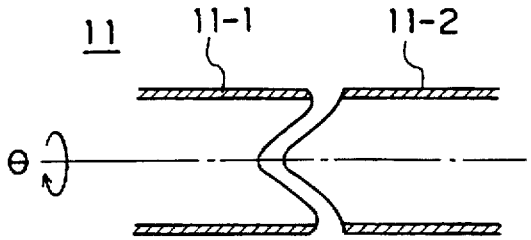
Figure 7C:
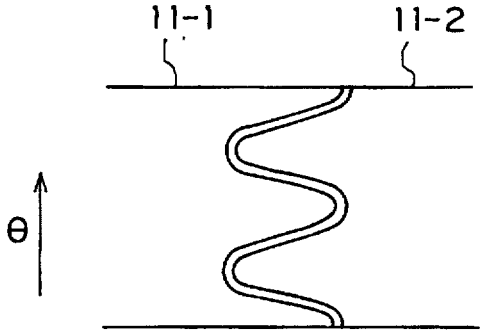

FIGS. 7A through 7C, FIGS. 8A and 8B and FIGS. 9A and 9B are respectively views for explaining configurations and effects of beam convergent lenses employed in the present embodiment. FIG. 7A illustrates one example of a structure of the conventional beam convergent lens using opposed cylindrical electrodes. FIG. 7B shows a structure of the beam convergent lens employed in the present embodiment. FIG. 7C is a view showing the beam convergent lens employed in the present embodiment, which is developed along an axis thereof.

In the conventional beam convergent lens shown in FIG. 7A, a potential difference is applied between the opposed two cylindrical electrodes so as to produce a beam converging action. At this time, however, spherical aberration is produced due to a difference in beam converging force between an inner peripheral portion and an outer peripheral portion of the lens. Since the conventional beam convergent lens has a simple configuration shown in FIG. 7A, the degree of freedom required on design, for correcting the spherical aberration, is reduced and hence the correction of spherical aberration has fallen into difficulties.

As shown in FIG. 7B, the beam convergent lens employed in the present embodiment is one wherein each of configurations of opposed sections of the opposed cylindrical electrodes are set so as to mate with a waveform along a circumferential direction. As a period of the waveform, two periods are shown so as to appear along the circumferential direction. However, the number of periods may be further increased. As a format of the beam convergent lens, a bi-potential type beam convergent lens using two electrodes or a uni-potential type beam convergent lens using three electrodes may be used.

Figure 8A:
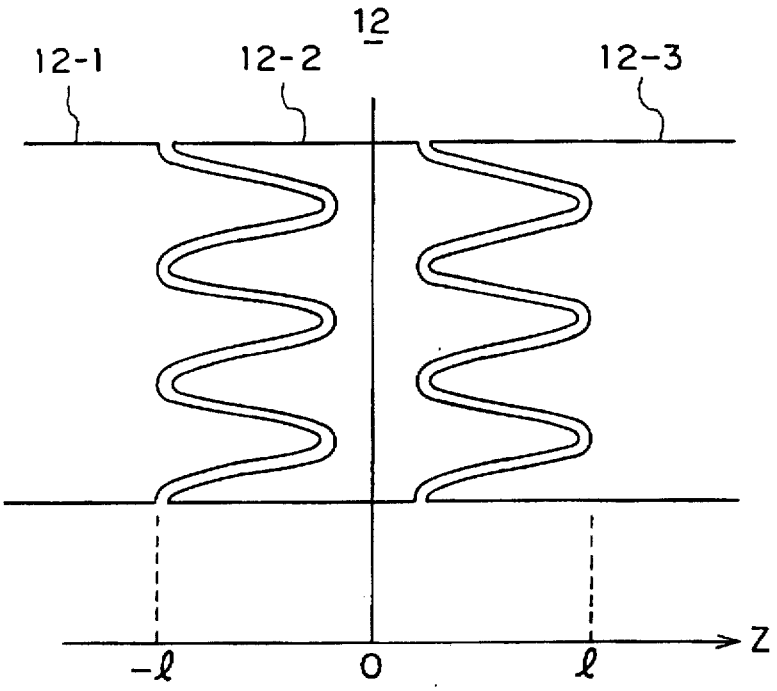
FIGS. 8A and 8B are respectively views illustrating another configuration and an effect of the CRT according to the seventh embodiment.
Figure 8B:
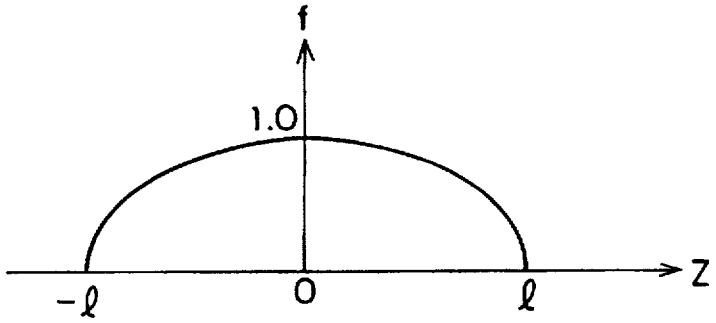

FIGS. 8A and 8B are views for describing the embodiment of the present invention, in which an electrode structure is employed in a uni-potential type beam convergent lens. The present beam convergent lens comprises outer electrodes 12-1 and 12-3 and an intermediate electrode 12-2 as shown in FIG. 8A. A beam converging action is produced by making a potential difference between a potential $V_1$ of each outer electrode and a potential $V_2$ of the intermediate electrode.

When the shape of a waveform mating portion is cut in a vertical direction with the lens as an axis, the length of the entire circumference is defined in accordance with the following equation, for example, with a rate occupied by the intermediate electrode 12-2 as f. The length of the intermediate electrode is defined as 2 l.

$$fV_2+(1-f)V_1=V_2+(V_1-V_2)(|Z|/l)^n \quad (1)$$

Figure 9A:
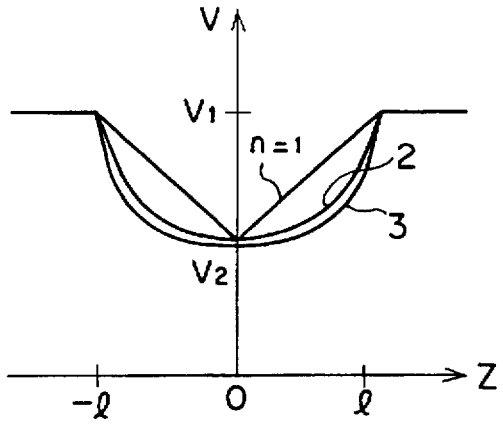
FIGS. 9A and 9B are respectively views showing other effects of the CRT according to the seventh embodiment.

A rate lf occupied by the intermediate electrode is brought to 1 in the center of the intermediate electrode as shown in FIG. 8B and is brought to zero at an end thereof. Further, n dominates a potential gradient at the end of the intermediate electrode. The potential gradient changes abruptly as n increases. An on-axis potential distribution at the time that n is varied, is shown in FIG. 9A.

Figure 9B:
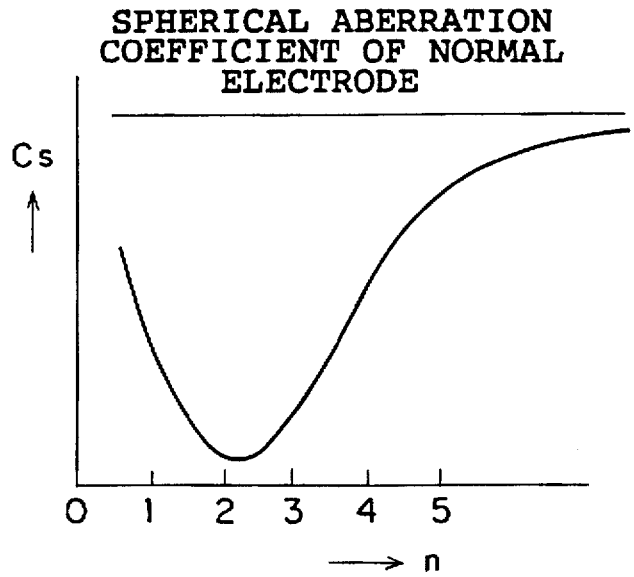

If a relationship between the value of n and a spherical aberration coefficient Cs is determined by calculation under such an electrode structure, then the result of determination is obtained as shown in FIG. 9B. It is understood that when n=2 to 3, the spherical aberration coefficient is greatly reduced. The function expressed in the equation (1) is shown as an illustrative example. A similar advantageous effect can be obtained even where a potential gradient at each end of an intermediate electrode is adjusted in accordance with a function indicative of a sawtooth waveform or the like as an alternative to the above function.

[Eighth embodiment]

The present embodiment shows another improvement in spherical aberration of a cylindrical beam convergent lens. In the present embodiment, a short cylindrical inner electrode having axially-extending slits defined therein is provided inside a cylindrical electrode as an alternative to each cylindrical electrode having the mating portion, which is employed in the seventh embodiment.

Figure 10A:
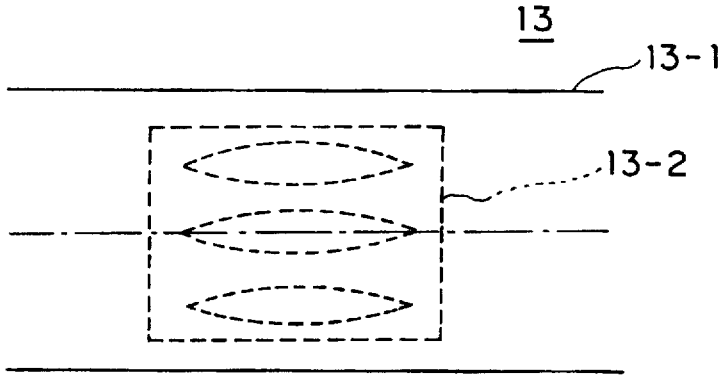
FIGS. 10A and 10B are respectively views depicting a configuration and an effect of a CRT according to an eighth embodiment of the present invention.
Figure 10B:
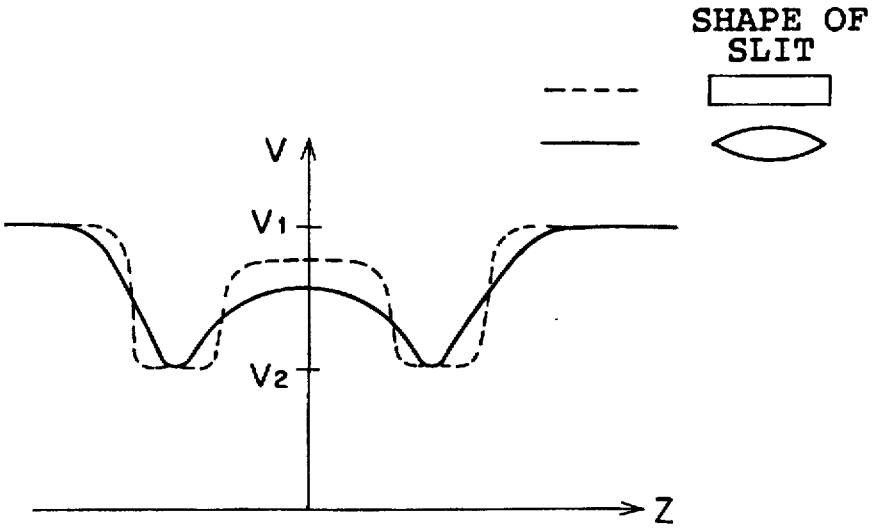

FIGS. 10A and 10B are respectively views for describing a configuration and an effect of a beam convergent lens employed in the present embodiment. FIG. 10A is a view showing a structure of the beam convergent lens. Reference numeral 13-1 indicates a cylindrical electrode. Reference numeral 13-2 indicates a cylindrical inner electrode disposed coaxially inside the cylindrical electrode 13-1 and having axially-extending slits defined therein. FIG. 10B shows an on-axis potential distribution in the beam convergent lens.

FIG. 10B illustrates the on-axis potential distribution in the beam convergent lens at the time that a potential at the outer cylindrical electrode is $V_1$ and a potential at the inner electrode is $V_2$ ($V_1>V_2$). Since the inner electrode extends over the entire circumference, an on-axis potential becomes close to $V_2$ at both ends of the inner electrode. Since, however, the slit is defined in the center of the inner electrode, the on-axis potential becomes an intermediate value between $V_1$ and $V_2$. The distribution of the on-axis potential depends on the shape of each slit. FIG. 10B illustrates rectangular and spindle-shaped slits as examples.

In the present embodiment, since the shape of the on-axis potential distribution can be changed depending on the configuration of each slit defined in the inner electrode, the slit configurations capable of reducing the spherical aberration coefficient can be realized by a technique similar to the seventh embodiment. Further, the cut-away portions of the inner electrode are set as the slits in the present embodiment. However, a similar effect can be brought about even when, for example, one obtained by combining and arranging holes different in size from one another is used.

[Ninth embodiment]

The present embodiment is intended to facilitate demagnetization of a frame on which a shadow mask of a CRT is mounted and prevent the quality of an image from being deteriorated due to magnetization of the frame.

Figure 11:
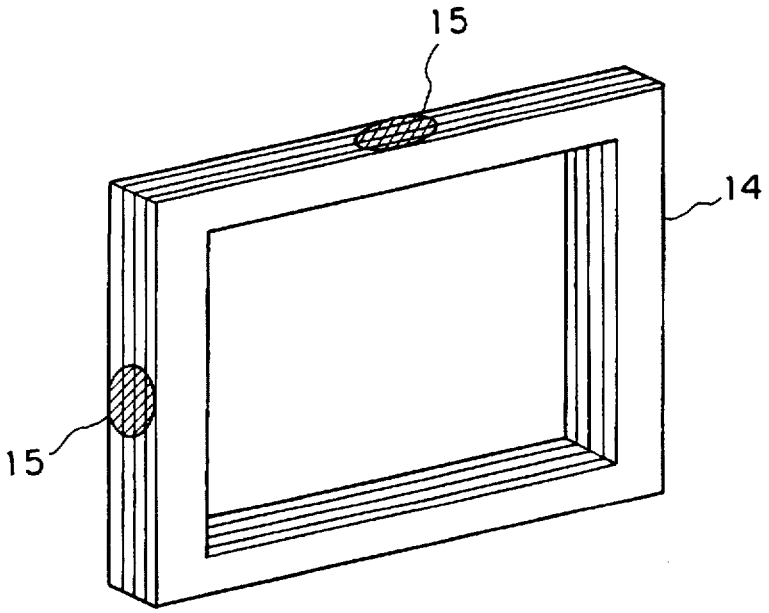
FIG. 11 is a view illustrating a configuration of a CRT according to a ninth embodiment of the present invention.

FIG. 11 is a view showing a structure of a frame on which a shadow mask employed in the present embodiment is mounted. In the drawing, reference numeral 14 indicates the frame on which the shadow mask is mounted, which is composed of stacked thin plate-like steel plates. Reference numeral 15 indicates a portion where the stacked steel plates are joined to one another.

Since the frame employed in the present embodiment is different from a conventional frame composed of thick plates each having a thickness of about 20 mm and is composed of the stacked thin plate-like steel plates, a demagnetizing high-frequency magnetic field penetrates into the frame to enable easy demagnetization. The thickness of each steel plate in which the high-frequency magnetic filed can penetrate, depends upon a skin thickness d based on the skin effect and is expressed by the following equation:

$$\delta=(1/2\pi f\sigma\mu)^{0.5} \quad (1)$$

where f: frequency

σ: conductance

μ: permeability

By setting the thickness of each steel plate so as to become smaller than σ in the equation (1), demagnetization is enabled using the high-frequency magnetic field. In the conventional frame composed of the thick plates, a frequency f of a penetrable high-frequency magnetic field is lowered so that a high-frequency power supply for generating a magnetic field encounters difficulties in its operation.

In general, a demagnetizing high-frequency power supply comprises a resonance circuit composed of a capacitor and a demagnetizing coil. A resonance frequency f and a decay time τ of the resonance circuit are expressed by the following equation:

$$f=1/2\pi(LC)^{0.5} \quad (2)$$

$$\tau=L/R \quad (3)$$

It is necessary to increase L and C in order to reduce the frequency f. However, a difficulty arises that a power supply is increased in size. If the frequency f is reduced, it is then necessary to make the decay time τ longer. This will create a difficulty that the resistance value of the demagnetizing coil must be lowered. Since the frequency of the high-frequency magnetic field can be increased if the frame is composed of the thin plate-like steel plates, the above difficulties can be solved. If an approximate value of the penetrable frequency f is determined from the equation (1), it is then on the order of 1 Hz in the case of a conventional plate thickness of the order of 1 cm. The approximate value is on the order of kHz in the case of a thin plate having a thickness range of 0.1 mm to 1 mm.

On the other hand, the frame needs a strength for maintaining the entire mechanical strength of CRT. Since, however, the direction of the necessary strength corresponds to the direction parallel to the surface of a screen of the CRT, a strength equivalent to that of each thick plate can be obtained if the thin plate-like steel plates are stacked on one another parallel to the screen and joined to each other. A method of joining the steel plates to each other may depend on spot welding or bonding.

By constructing the conventional frame of shadow mask as in the present embodiment, the magnetization of the frame can be demagnetized by the conventional demagnetizing high-frequency magnetic field. Accordingly, each beam spot can be prevented from being deteriorated due to a magnetic field at the magnetized frame, thereby making it possible to obtain a distortion-free image with high resolution.

[Tenth embodiment]

The present embodiment describes an apparatus for demagnetizing a magnetized frame of a shadow mask using conventional thick plates and preventing a beam spot from being deteriorated due to magnetization of the frame to thereby improve resolution of a CRT.

Figure 12A:
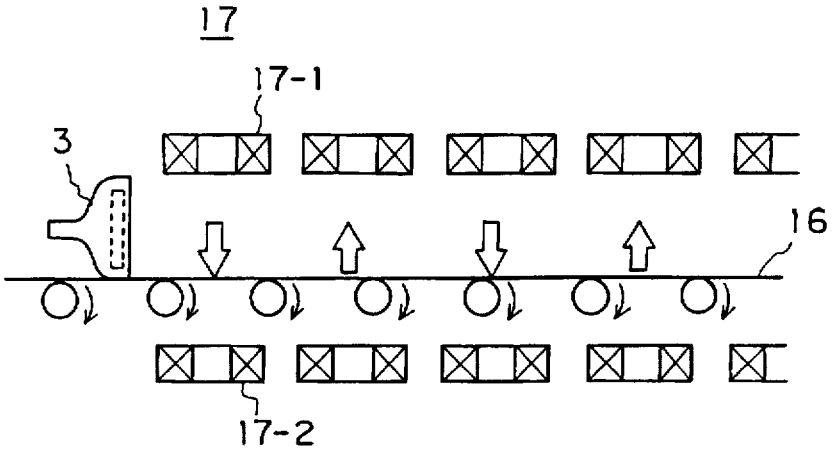
FIGS. 12A through 12C are respectively views showing a configuration and effects of a CRT according to a tenth embodiment of the present invention.
Figure 12B:
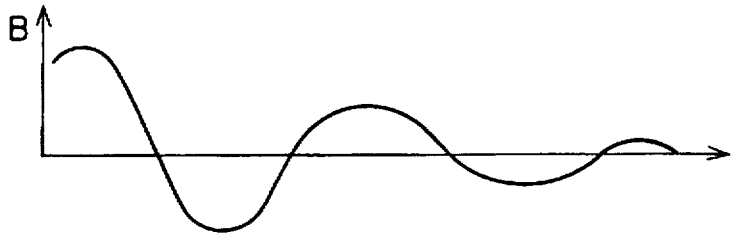
Figure 12C:
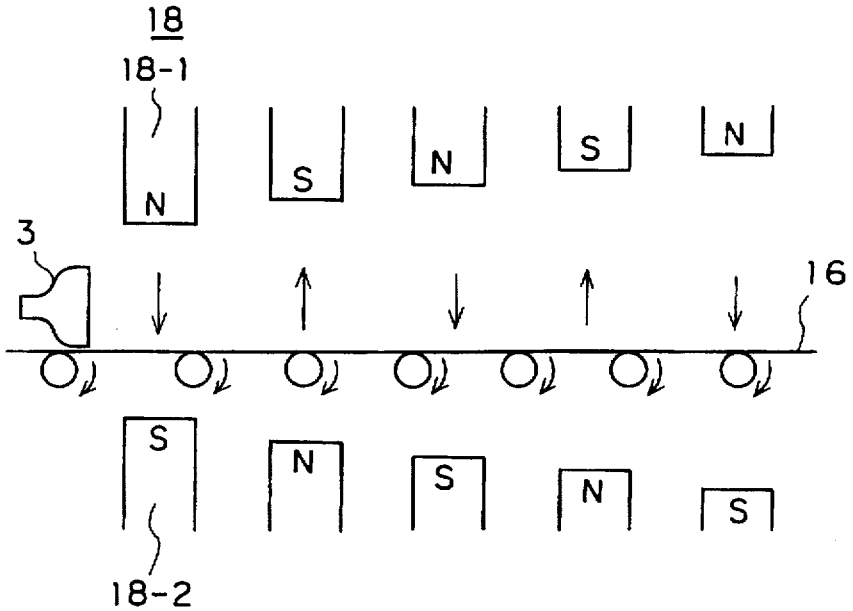

FIGS. 12A through 12C are respectively views for explaining a configuration and effects of the present embodiment. In FIG. 12A, reference numeral 3 indicates a CRT tube having a frame of a shadow mask, which is provided thereinside. Reference numeral 16 indicates a conveyor for conveying the CRT tube from left to right as seen in FIG. 12A. Reference numeral 17 indicates a plurality of pairs of d.c. electromagnets each pair of which is composed of electromagnets 17-1 and 17-2 provided in pair, for producing a magnetic field of the same direction so as to extend in upward and downward directions of the conveyor 16 for the CRT. The electromagnets 17 are repeatedly disposed along the conveyor 16 and the direction of each magnetic field is inverted for each pair. Each arrow shows the direction of the magnetic field, which is inverted on an alternate basis. The strength of the magnetic field produced by each electromagnet 17 is gradually reduced from the upstream side of the conveyor 16 to the downstream side thereof. The direction of arrangement of the electromagnets may be set in upward and downward directions or in left and right directions with the conveyor interposed therebetween. As an alternative to a gradual reduction in the strength of the magnetic field of the electromagnet toward the downstream side of the conveyor, an interval between the electromagnets 17-1 and 17-2 may be gradually increased toward the downstream side of the conveyor.

The operation of the present embodiment will now be described. The CRT tube 3 undergoes a direction-alternating magnetic field from the repeatedly-provided electromagnets in the course of conveyance of the CRT tube 3 by the conveyor 16. Since the strength of the alternating field is reduced from upstream to downstream, the magnetic field subjected to the CRT tube becomes an alternating field attenuated as shown in FIG. 12B.

The frame magnetized by the attenuated alternating field can be generally demagnetized. However, the feature of the present embodiment is that the demagnetizing high-frequency magnetic field employed in the present embodiment is different from that employed in the conventional example and an alternating frequency of the magnetic field can be lowered as needed. The alternating frequency can be controlled by adjusting the speed of the conveyor and the interval between the adjacent electromagnets. Since the conventional frame of shadow mask is composed of the thick plates, a very low alternating frequency is required to penetrate the demagnetizing magnetic field into the frame. It is also difficult to demagnetize the frame with the conventional demagnetizing high-frequency magnetic field. Since, however, a desired low alternating frequency can be obtained in the present embodiment, the frame can be easily demagnetized. As a result, the beam spot can be prevented from being deteriorated due to the magnetic field at the magnetized frame, thereby making it possible to obtain a distortion-free image over the entire surface of the screen with high resolution.

FIG. 12C shows the embodiment using a plurality of pairs of permanent magnets 18 as an alternative to the d.c. electromagnets 17 shown in FIG. 12A. Each pair of permanent magnets 18 is composed of permanent magnets 18-1 and 18-2 provided in pair and whose polarities are opposed to each other. The permanent magnets 18 are repeatedly disposed along the conveyor 16 and the direction of a magnetic field is inverted for each pair. The strength of each magnet is gradually reduced from the upstream side of the conveyor 16 to the downstream side thereof. Accordingly, the magnetic field subjected to the CRT tube 3 in the course of conveyance of the CRT tube 3 by the conveyor 16 becomes the alternating field attenuated as shown in FIG. 12B in the same manner as FIG. 12A. Thus, the embodiment shown in FIG. 12C can bring about operations and effects similar to those obtained in the embodiment shown in FIG. 12A.

[Eleventh embodiment]

The present embodiment relates to other method of and an apparatus for applying a low-frequency alternating magnetic field to a frame of a shadow mask to demagnetize the frame in a manner similar to the tenth embodiment.

Figure 13A:
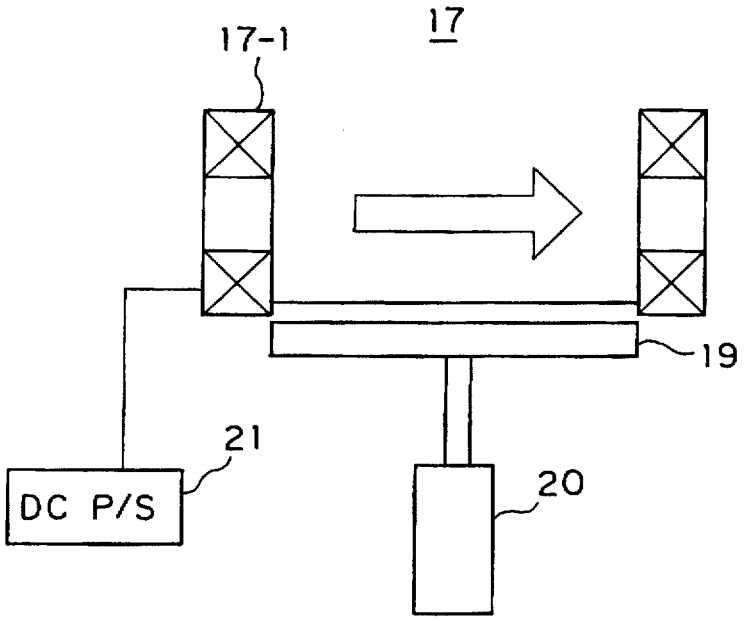
FIGS. 13A and 13B are respectively views illustrating a configuration and an effect of a CRT according to an eleventh embodiment of the present invention.

In FIG. 13A, reference numeral 17 indicates a d.c. electromagnet. Reference numeral 19 indicates a rotatable table for placing a CRT tube thereon. Reference numeral 20 indicates a drive mechanism such as a motor or the like for rotating the rotatable table 19. Reference numeral 21 indicates a power supply used for the d.c. electromagnet 17, which is able to vary an output current in accordance with a predetermined pattern.

Figure 13B:
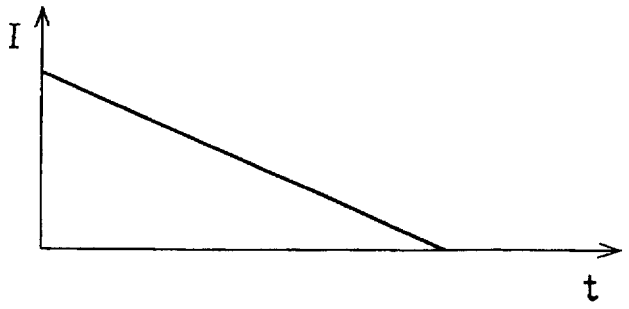

The d.c. electromagnet 17 is composed of a pair of electromagnets 17-1 and 17-2 for producing a magnetic field in the same direction (i.e., arrow direction). The CRT tube is placed on the rotatable table 19 and is rotated between the pair of electromagnets 17-1 and 17-2. Thus, the CRT tube undergoes a direction-alternating magnetic field. If the current supplied from the power supply 21 is now varied in accordance with a pattern reduced with time as shown in FIG. 13B, then the CRT tube is subjected to the attenuated alternating field. Since an alternating frequency of the magnetic field depends on a rotational speed of the motor 20, a desired low frequency can be set so that the frame composed of the thick plates can be demagnetized in a manner similar to the tenth embodiment.

Figure 14A:
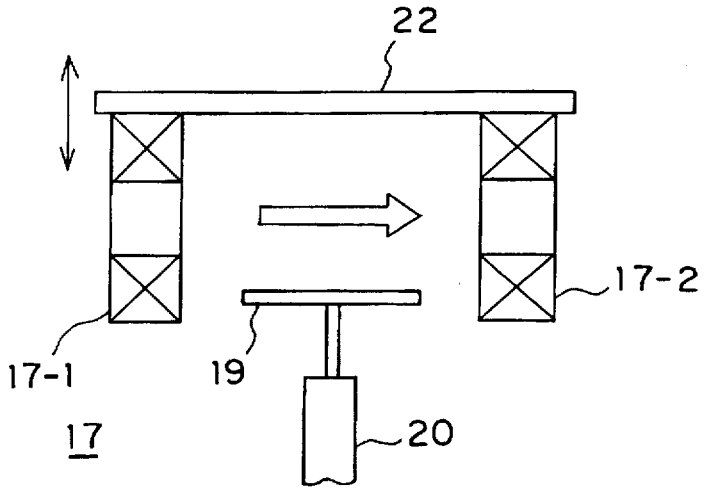
FIGS. 14A and 14B are respectively views showing other configuration and effect of the CRT according to the eleventh embodiment.
Figure 14B:
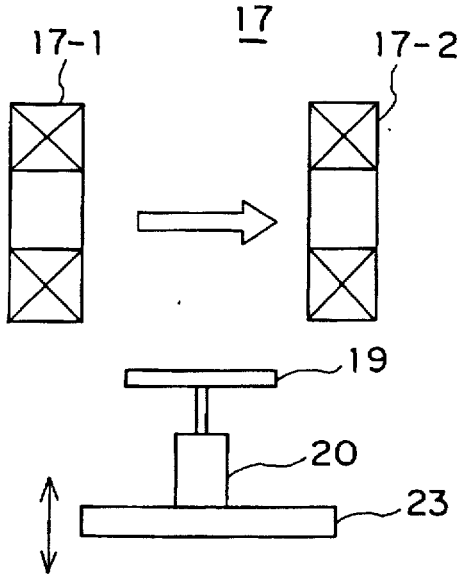
Figure 15A:
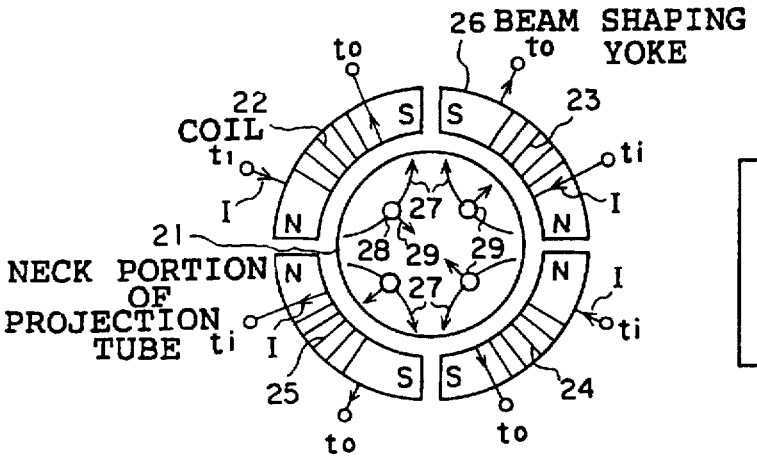
FIG. 15A (PRIOR ART)
FIGS. 15A through 15F are respectively views illustrating configurations and effects of a first prior art.
Figure 15B:
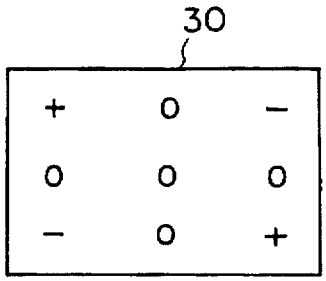
FIG. 15B (PRIOR ART)
Figure 15C:
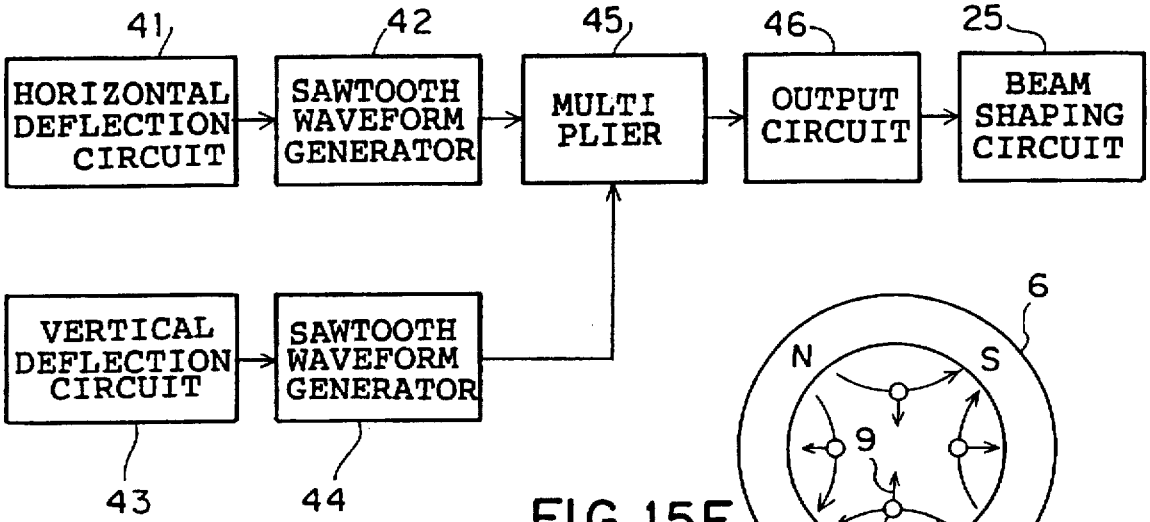
FIG. 15C (PRIOR ART)
Figure 15E:
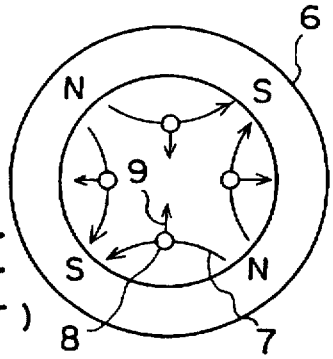
FIG.15E (PRIOR ART)
Figure 15D:
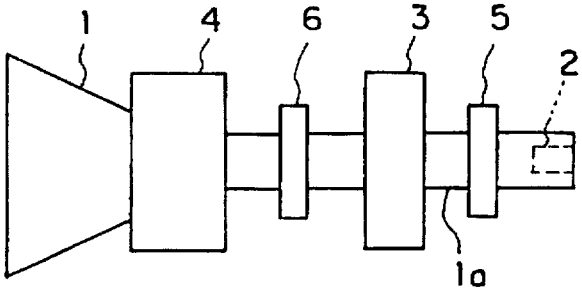
FIG. 15D (PRIOR ART)
Figure 15F:
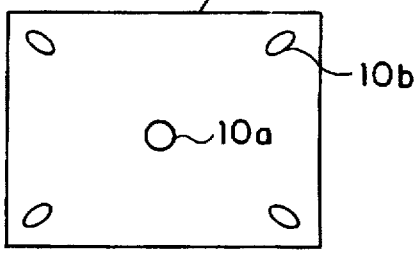
FIG. 15F (PRIOR ART)
Figure 16A:
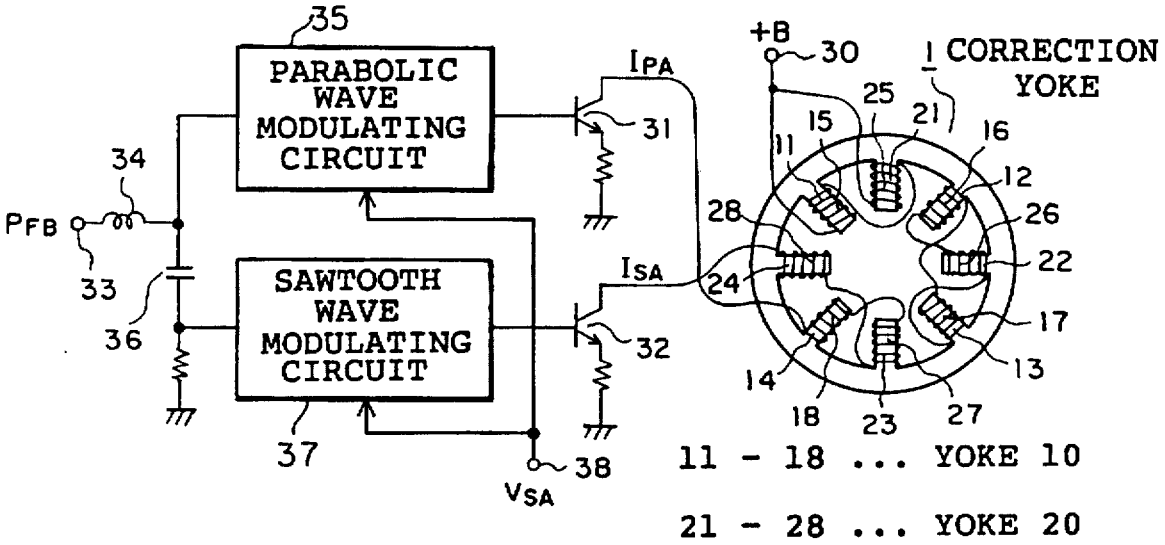
FIG. 16A (PRIOR ART)
FIGS. 16A through 16E are respectively views depicting configurations and operating characteristics of a second prior art device.
Figure 16B:
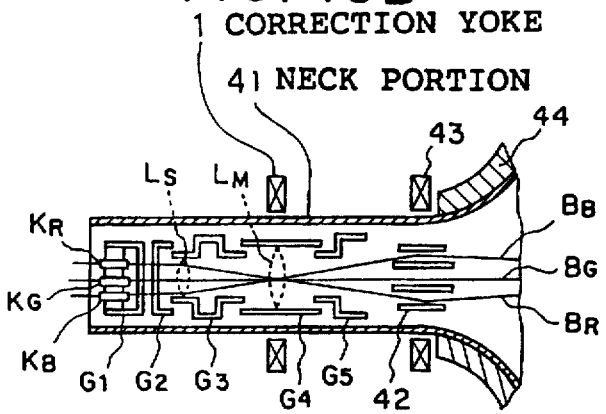
FIG. 16B (PRIOR ART)
Figure 16D:
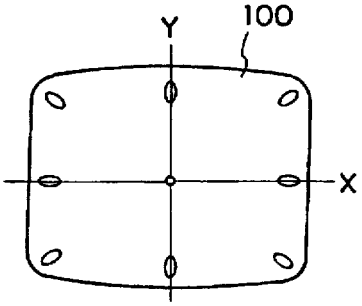
FIG. 16D (PRIOR ART)
Figure 16C:
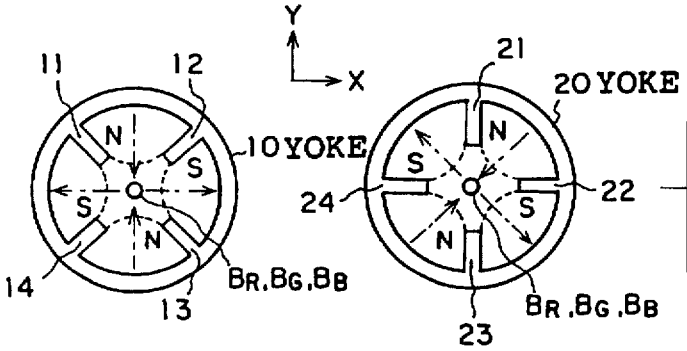
FIG. 16C (PRIOR ART)
Figure 16E:
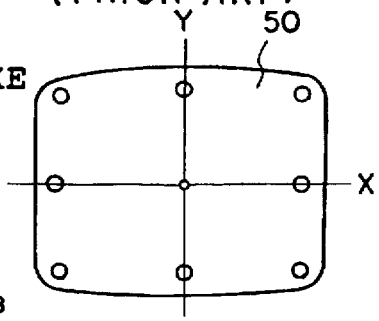
FIG. 16E (PRIOR ART)
Figure 17A:
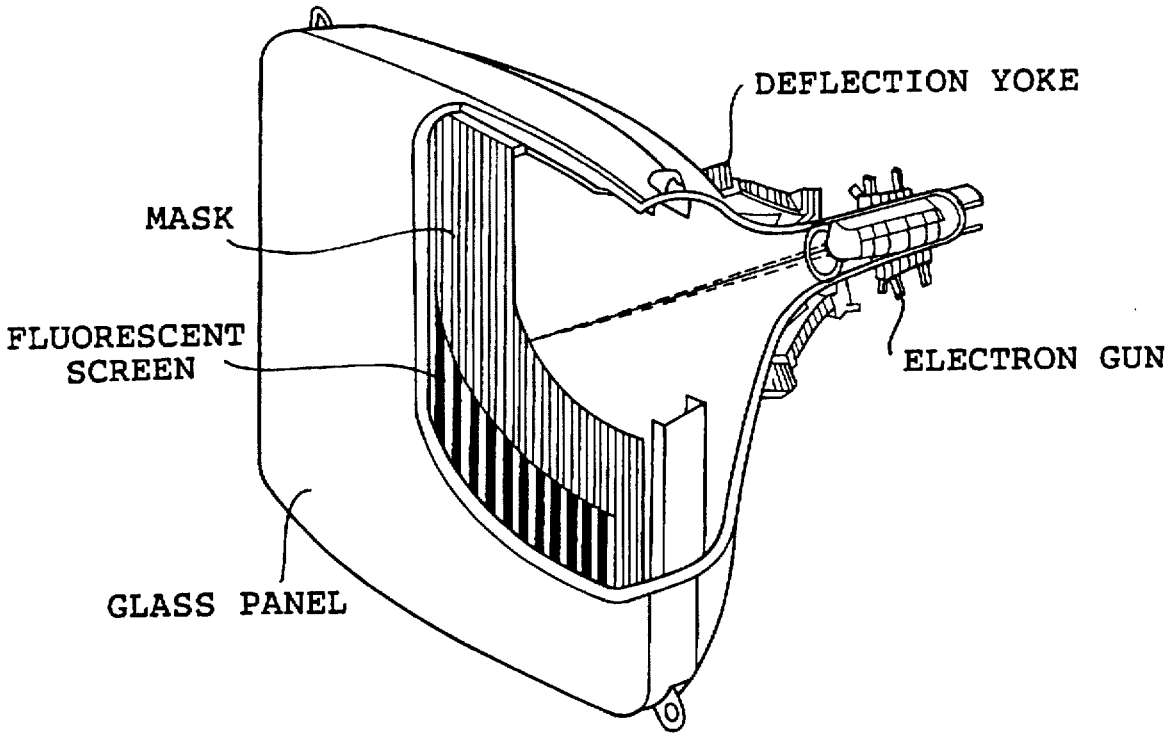
FIG. 17A (PRIOR ART)
FIGS. 17A and 17B are respectively views illustrating configurations of a third prior art device.
Figure 17B:
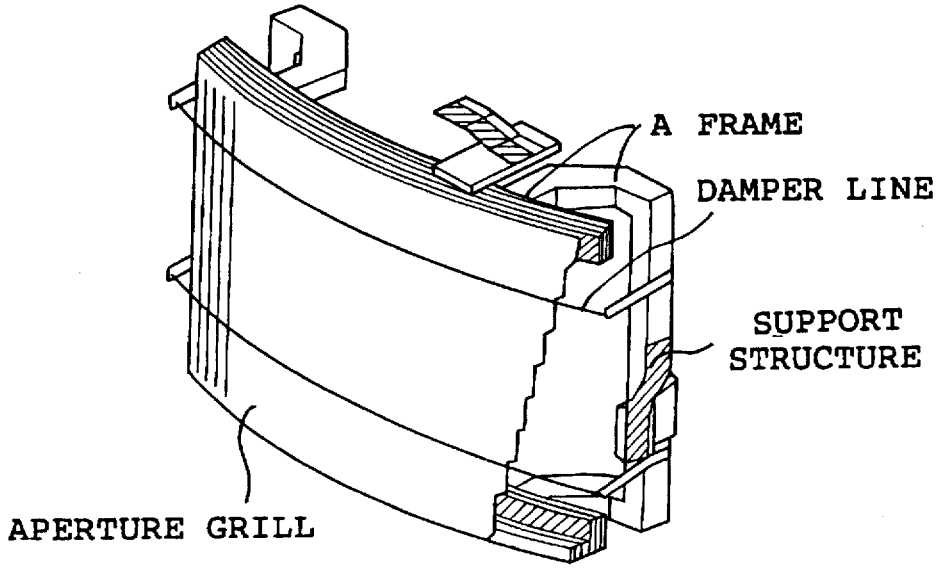
FIG. 17B (PRIOR ART)

FIGS. 14A and 14B respectively show other modifications in which the distance between an electromagnet and a CRT tube is varied as an alternative to a change in the output current of the power supply 21 in the embodiment shown in FIG. 13A. FIG. 14A shows a case where an electromagnet 17 is displaced upward and downward from a rest or mount 22. In the early stage of demagnetizing process, the electromagnets 17-1 and 17-2 are placed in positions where they interpose the CRT tube rotated on the rotatable table 19. The electromagnets 17-1 and 17-2 are withdrawn upward with the elapse of time so as to be separated from the CRT tube. Thus, the CRT tube is subjected to an alternating field attenuated with time so that a frame is demagnetized in a manner similar to the embodiment shown in FIGS. 13A and 13B. Since it is unnecessary to vary the strength of a magnetic field of each electromagnet in the present embodiment, a permanent magnet may be used as an alternative to the electromagnet 17.

FIG. 14B illustrates the modification in which a turntable 19 of a CRT and a motor 20 are displaced upward and downward from a mount 23 as an alternative to the movement of the electromagnet 17 in the upward and downward directions in FIG. 14A. Operations and effects similar to those obtained in the embodiment shown in FIG. 14A can be brought about.

According to the first and second aspects of the present invention as is apparent from the above description, an advantageous effect can be brought about that since a sextupole magnetic field of a deflection yoke is unnecessary, a strong astigmatism is prevented from occurring due to the sextupole magnetic field and since each astigmatism correcting means can be provided adjacent to a portion where astigmatism is produced, the astigmatism can be effectively corrected and satisfactory spot shapes can be obtained over the entire surface of a screen, thereby making it possible to obtain high resolution.

According to the third through fifth aspects of the present invention, an advantageous effect can be brought about that a single skew quadrupole magnet may be provided as an alternative to quadrupole magnets or skew quadrupole magnets that were necessary to provide in plural form and satisfactory spot shapes can be obtained over the entire surface of a screen, thereby making it possible to obtain high resolution.

According to the sixth aspect of the present invention, an advantageous effect can be brought about that the excess and deficiency of correction of coma-aberration can be easily adjusted and satisfactory spot shapes can be obtained over the entire surface of a screen, thereby making it possible to obtain high resolution.

According to the seventh aspect of the present invention, an advantageous effect can be brought about that since astigmatism can be satisfactorily corrected and can be stably corrected even when the position of a beam varies, satisfactory spot shapes can be obtained over the entire surface of a screen, thereby making it possible to obtain high resolution.

According to the eighth and ninth aspects of the present invention, an advantageous effect can be brought about that spherical astigmatism of a beam convergent lens is reduced and satisfactory spot shapes can be obtained over the entire surface of a screen, thereby making it possible to obtain high resolution.

According to the tenth aspect of the present invention, an advantageous effect can be brought about that a conventional frame of a shadow mask can be easily demagnetized by a demagnetizing high-frequency electric field and satisfactory spot shapes can be obtained over the entire surface of a screen, thereby making it possible to obtain high resolution.

According to the eleventh through thirteenth aspects of the present invention, an advantageous effect can be brought about that a conventional frame of a shadow mask, which is composed of thick plates, can be easily demagnetized and satisfactory spot shapes can be obtained over the entire surface of a screen, thereby making it possible to obtain high resolution.

According to the fourteenth aspect of the present invention, an advantageous effect can be brought about that a conventional frame of a shadow mask, which is composed of thick plates, can be easily demagnetized and satisfactory spot shapes can be obtained over the entire surface of a screen, thereby making it possible to obtain high resolution.

Having now fully described the invention, it will be apparent to those skilled in the art that many changes and modifications can be made without departing from the spirit or scope of the invention as set forth herein.

What is claimed is:

1. An in-line beam type CRT comprising:

a first set of electromagnets provided around a neck portion of said CRT for providing a first quadrupole field;

a second set of electromagnets rotated by 45 degrees about a beam axis, said second set of electromagnets also being provided around the neck portion of said CRT; and an electric field lens comprising one or more electrodes driven by control voltages within an electron gun, for respectively applying quadrupole electric fields to beams, wherein said electric field lens is displaced from said first and said second sets of electromagnets along an axis of beam travel.

2. A CRT according to claim 1, wherein said electric field lens corrects astigmatism in a horizontal and vertical directions of said beams.

3. A CRT according to claim 1, wherein said first quadrupole field adjusts convergence of said beams.

4. A CRT according to claim 1, wherein said second quadrupole field corrects astigmatism in a skewed direction relative to said first quadrupole field.

5. A CRT according to claim 1, wherein said electric field lens corrects astigmatism in a horizontal and vertical directions of said beams;

wherein said first quadrupole field adjusts convergence of said beams; and wherein said second quadrupole field corrects astigmatism in a skewed direction relative to said first quadrupole field.

6. An in-line beam type CRT comprising:

a first set of electromagnets provided around a neck portion of said CRT;

a second set of electromagnets rotated by 45 degrees about a beam axis, said second set of electromagnets also being provided around the neck portion of said CRT; and an electric field lens comprising one or more electrodes driven by control voltages within an electron gun through which a central beam and outer beams pass, for inwardly deflecting said outer beams.

7. A CRT according to claim 6, wherein said electric field lens comprises two plate-like electrodes for deflecting said outer beams when a potential difference is applied thereto.

8. A CRT according to claim 7, wherein said two plate-like electrodes comprise a first and a second plate-like electrodes, and wherein said first and second plate-like electrodes each include two tooth-shaped electrodes, and wherein the two tooth-shaped electrodes of said first plate-like electrode bracket said two tooth-shaped electrodes of said second plate-like electrode.

9. A single beam type CRT including a deflection yoke including means for producing sextupole components of horizontal and vertical magnetic fields disposed in a triplet arrangement, and further including a skew quadrupole magnet disposed around a neck portion of said CRT;

wherein said triplet arrangement comprises a first divergence of said magnetic fields, followed by a convergence of said magnetic fields, followed by a second divergence of said magnetic fields.

10. A CRT according to claim 9, wherein the means for producing the triplet arrangement comprises a deflection coil having winding distributions.

11. A CRT according to claim 9, wherein the means for producing the triplet arrangement comprises a pair of magnetic members disposed before and after the deflection yoke for inverting a sign of each sextupole magnetic field.

12. An in-line beam type CRT having a self-converged yoke, comprising:

a coma-aberration correcting sextupole magnet provided around a neck portion of said CRT, for setting an amount of correction for coma-aberration which exceeds a strength necessary to correct coma-aberration; and a ring made of a magnetic substance, said ring being provided laterally adjacent to said sextupole magnet, wherein a distance between said sextupole magnet and said ring is adjustable by moving said ring, so as to modify the amount of correction for coma-aberration.

13. A CRT comprising:

a quadrupole electric field lens for correcting astigmatism produced due to deflection of an in-line type beam, and having convex opposing electrodes, the opposing electrodes being disposed at right angles to each other, each said convex electrode having such a shape that a width thereof is varied along a beam axis.

14. A CRT comprising:

a beam convergent lens having an inner coaxially-provided cylindrical electrode with slits defined therein, said slits being provided inside the inner cylindrical electrode and having lengths shorter than a length of the inner cylindrical electrode, said slits further extending in an axial direction of said inner cylindrical electrode, wherein said inner electrode is disposed within an outer cylindrical electrode.

15. A CRT comprising a quadrupole electric field lens for correcting astigmatism in said CRT, said lens comprising:

a first pair of convex electrodes which bracket a beam; and a second pair of convex electrodes which bracket said beam;

wherein said first pair of convex electrodes is opposed to said second pair of convex electrodes, and said second pair of convex electrodes is rotated from said first pair of convex electrodes by approximately 90 degrees.

* * * * *